United States Patent [19]

Bradbury

[11] Patent Number: 4,942,983

[45] Date of Patent: Jul. 24, 1990

[54] APPARATUS FOR STORING AND DISPENSING PARTICULATE ICE

[76] Inventor: John R. Bradbury, 6111 Quail Feather La., San Antonio, Tex. 78233

[21] Appl. No.: 266,309

[22] Filed: Oct. 31, 1988

Related U.S. Application Data

[63] Continuation of Ser. No. 944,845, Dec. 18, 1986, abandoned.

[51] Int. Cl.[5] ..... G01F 11/20

[52] U.S. Cl. ..... 222/238; 222/333; 222/413; 222/517; 141/360; 198/550.1; 384/149

[58] Field of Search ..... 384/139, 142, 149

[56] References Cited

U.S. PATENT DOCUMENTS

| | | | |
|---|---|---|---|
| D. 265,203 | 6/1982 | Lents et al. | D15/80 |
| D. 269,785 | 7/1983 | Lents et al. | D15/80 |
| 2,616,592 | 11/1952 | Boughman | 222/238 X |
| 3,151,668 | 10/1964 | Zimmermann | 62/344 X |
| 3,610,482 | 10/1971 | Steenburgh, Jr. | 222/413 |
| 3,719,307 | 3/1973 | Larson | 222/413 X |
| 3,913,343 | 10/1975 | Rowland et al. | 62/344 X |
| 4,136,803 | 1/1979 | Tobias et al. | 222/413 |
| 4,346,824 | 8/1982 | Miller et al. | 222/504 |
| 4,354,613 | 10/1982 | Desai et al. | 221/4 |
| 4,423,830 | 1/1984 | Lents et al. | 222/146 C |

FOREIGN PATENT DOCUMENTS

| | | | |
|---|---|---|---|
| 8105542 | 3/1981 | France | 141/94 |

*Primary Examiner*—Joseph J. Rolla
*Assistant Examiner*—Gregory L. Huson
*Attorney, Agent, or Firm*—Cox & Smith Incorporated

[57] ABSTRACT

An apparatus for dispensing particulate ice including a case with an ice hopper therein for storage of ice. The ice hopper is provided with a downwardly sloped floor. An auger assembly is provided for moving ice within the ice hopper upwardly along the sloped floor from the lower end to dispense the ice from an opening at the upper end thereof. The apparatus is also provided with a lever arm, electric circuitry, and a motor mounted within the case in the space inside the walls thereof and under the sloped floor of the ice hopper for selectively activating the auger assembly. The auger assembly includes a rotating shaft which is sealed against the stationary ice hopper in a packing case, the packing case having a hole therethrough for receiving the rotating shaft, a seal cap and a thrust bearing. The sealing cap is provided with a seal for sealing against both the packing case and the rotating shaft.

7 Claims, 2 Drawing Sheets

APPARATUS FOR STORING AND DISPENSING PARTICULATE ICE

This application is a continuation of co-pending application Ser. No. 944,845, filed Dec. 18, 1986 and now abandoned.

BACKGROUND OF THE INVENTION

The present invention relates to an apparatus and method of storing and selectively dispensing particulate ice. More particularly, the present invention pertains to an ice storage and dispensing apparatus which provides easy accessibility to a large quantity of particulate ice but occupies a relatively small amount of counter space in a food service establishment.

A number of devices for storing and dispensing particulate ice are currently available. Such devices include a hopper for storage of ice therein, generally of rectangular shape, having generally perpendicular walls. Such a construction generally includes some mechanical means which is selectively activated by pressing against a lever arm pivotally mounted to the front of the hopper for moving the ice out of the hopper through a gate as shown in U.S. Pat. No. 4,346,824. However, such dispensers are generally either large and bulky, thereby taking up a large amount of space, or so small that they contain so little ice that they must often be re-filled, thereby requiring additional employee time to supply them with ice. Reference to two design patents illustrates this dilemma: U.S. Des. No. 265,203 describes a large, free-standing dispenser and U.S. Des. No. 269,785 describes a much smaller, counter-top dispenser. On information and belief, either or both of the dispensers disclosed in those two design patents would include a mechanism such as is disclosed in U.S. Pat. No. 4,346,824.

In many modern food service establishments, space and manpower requirements are significant factors in the profitability of the business. Such is especially the case in restaurants such as those which are known as fast food-type restaurants, particularly in those fast food outlets which have become particularly attractive in recent years which are located, for instance, in the parking lots of other business establishments which require only two or three person crews to operate, and which serve relatively high volumes of food in short periods of time. Food service apparatus which occupies a small amount of space and which requires only occasional re-filling or service is particularly well suited, if not essential, for such restaurants. Consequently, devices such as those shown in U.S. Pat. No. 4,346,824 and Pat. Nos. Des. 265,203 and Des. 269,785, are of limited utility in such restaurants.

The present invention is based upon the discovery that significant space savings are made possible by the use of a sloped floor in the ice hopper of the dispenser and the use of structure which allows the motor and means for activating the motor to move the ice out of the hopper to be located in the space formed between the walls of the device and the underside of the upper end of the sloped floor of the ice hopper. The use of a "canted" floor in an ice hopper is disclosed in U.S. Pat. No. 4,423,830, but the cant in the floor of the ice hopper disclosed in that patent is to provide for the draining of water therefrom and the motor and means for activating the motor to move ice out of the hopper is not located under the canted floor. Therefore, that device suffers from the same disadvantages and limitations as the above-characterized dispensers; namely, the relatively large size or, if built smaller, the limited capacity for storage of particulate ice.

Another problem with the construction of ice dispensers such as those disclosed in U.S. Pat. Nos. 4,346,824 and 4,423,830 is that the means for moving the ice within the ice hopper tends merely to move the mass of ice around in a circle inside the ice hopper rather than to mechanically break apart the particulate ice. Breaking the ice apart prevents the bridging and/or congealing of the ice in a manner which causes the apparatus to either stop dispensing ice from the hopper before the ice hopper is empty or which causes the ice bridges to jam between the means for moving the ice and the interior walls of the ice hopper itself. In either situation, the apparatus must be serviced, which is exactly the situation which the operator of the food service establishment desires to avoid. The present invention overcomes that limitation and disadvantage of prior art ice dispensers by providing a means for mechanically breaking up the ice before it is moved out of the ice hopper by the means for moving the ice out of the hopper.

Another disadvantage and limitation of prior art ice dispensers is their tendency to dispense ice which is relatively "wet" in the sense that the ice dispensed is partially melted. Generally, the ice dispensed from such dispensers is wet because the ice is dispensed from the bottom of the ice hopper. The ice at the bottom of the ice hopper is wet because all the water from the ice in the upper part of the ice hopper runs to the bottom of the hopper as it melts. The present invention overcomes that limitation by providing a sloped floor in the ice hopper, a drain at the lower end of the sloped floor, and means for moving the ice at the bottom of the ice hopper upwardly along the sloped floor, out of any melt water which may have collected there, and out of the ice hopper. The drain is located at the lower end of the sloped floor so that water from the melted ice will run downwardly along the sloped floor and out of the hopper. The fact that the drain is set at an angle to the horizontal, i.e., in the sloped floor, makes the drain less likely to clog or freeze up from partially melted ice.

It is, therefore, an object of the present invention to provide an apparatus for storing and dispensing particulate ice comprising a substantially rectangular case having an ice hopper therein for storage of particulate ice, the case having substantially vertical side walls and the floor of the ice hopper sloping downwardly within the case, means for moving particulate ice contained within the ice hopper upwardly along the sloped floor from the lower end of the floor to the upper end thereof, means at the upper end of the sloped floor of the ice hopper for dispensing particulate ice therefrom, and means mounted to said case in the space inside the substantially rectangular walls thereof and under the sloped floor of the ice hopper for selectively activating the ice moving means, thereby moving ice upwardly along the sloped floor of the ice hopper to the ice dispensing means at the upper end thereof and out of the ice hopper therethrough.

Another object of the present invention to provide an apparatus for storing and dispensing particulate ice which is sanitary and which dispenses ice without requiring a user to touch the ice.

Another object of the present invention is to provide an apparatus for storing and dispensing particulate ice which does not generate excessive amounts of heat, motor noise, or vibration when in use, the mechanism being activated only when ice is being dispensed.

A further object of the present invention is to provide an apparatus for storing and dispensing particulate ice having a drain which is less likely to freeze over or plug up than the drains of those dispensers which are currently available because the drain is set in the floor of the ice hopper at an angle from the horizontal.

Yet another object of the present invention is to provide a apparatus for storing and dispensing particulate ice which prevents ice from jamming in the discharge chute, the ice being mechanically agitated by the dual action of a screw and stirring bars located within the ice hopper of the storage and dispensing apparatus.

Another object of the present invention is to provide an ice dispensing apparatus which stores enough ice therein so as not to require frequent re-filling.

Another object of the present invention is to provide an ice dispensing apparatus which stores relatively large quantities of ice therein but which does not occupy a large amount of counter space in a food service establishment.

Another object of the present invention is to provide a method of dispensing particulate ice from a storage and dispensing apparatus comprising loading an ice hopper with particulate ice, directing the ice within the ice hopper to the lower end of the sloped floor of the ice hopper, and agitating the ice contained within the ice hopper and moving the ice upwardly along the sloped floor of the ice hopper from the lower end thereof to dispense the ice from an opening in the upper end of the sloped floor while draining the melt water from the ice at the lower end thereof.

Another object of the present invention is to provide an apparatus for storing and dispensing particulate ice which permits the user to control the quantity of ice dispensed.

A further object of the present invention is to provide an apparatus for storing and dispensing particulate ice which dispenses relatively dry ice in that the apparatus permits melt water to be drained from the ice before the ice is dispensed therefrom.

A further object of the present invention is to provide an apparatus for storing and dispensing particulate ice which is easy to clean and practical to use.

Other objects and advantages will be apparent to those skilled in the art who have the benefit of this disclosure from the following description of a presently preferred embodiment of the invention and the drawings referred to therein.

SUMMARY OF THE INVENTION

These objects are accomplished by providing an apparatus for storing and dispensing particulate ice comprising a substantially rectangular case having an ice hopper therein for storage of particulate ice, the ice hopper having substantially vertical side walls and a floor which slopes downwardly within the case, and means for moving particulate ice contained within the ice hopper upwardly along the sloped floor from the lower end of the floor to the upper end thereof. Means is provided at the upper end of the sloped floor of the ice hopper for dispensing particulate ice therefrom, and means is mounted to the case in the space formed by the substantially rectangular walls and the sloped floor of the ice hopper for selectively activating the ice moving means to move ice upwardly along the sloped floor of the ice hopper to the ice dispensing means at the upper end thereof and out of the ice hopper therethrough.

The ice hopper is provided with an apparatus for sealing the rotating shaft of the ice moving means in the stationary ice hopper comprising a packing case mounted in the stationary ice hopper and having a hole therethrough for receiving a rotating shaft. A seal cap is received within the hole in the packing case and is provided with means for sealing the seal cap against the packing case and means for sealing the seal cap against the rotating shaft. A thrust bearing is also mounted to the stationary ice hopper and is received within the hole in the packing case and has a hole therethrough for receiving the rotating shaft.

Also provided is a method if dispensing particulate ice from an ice storage apparatus comprising loading the ice hopper of an ice dispensing apparatus with particulate ice, selectively mechanically agitating the ice contained within the ice hopper, directing the ice within the ice hopper to the lower end of the sloped floor of the ice hopper, and moving the ice upwardly along the sloped floor of the ice hopper while the ice is being mechanically agitated to dispense the ice from the upper end of the sloped floor while draining the melt water from the ice at the lower end of the sloped floor.

DETAILED DESCRIPTION OF THE INVENTION

Figure 1:
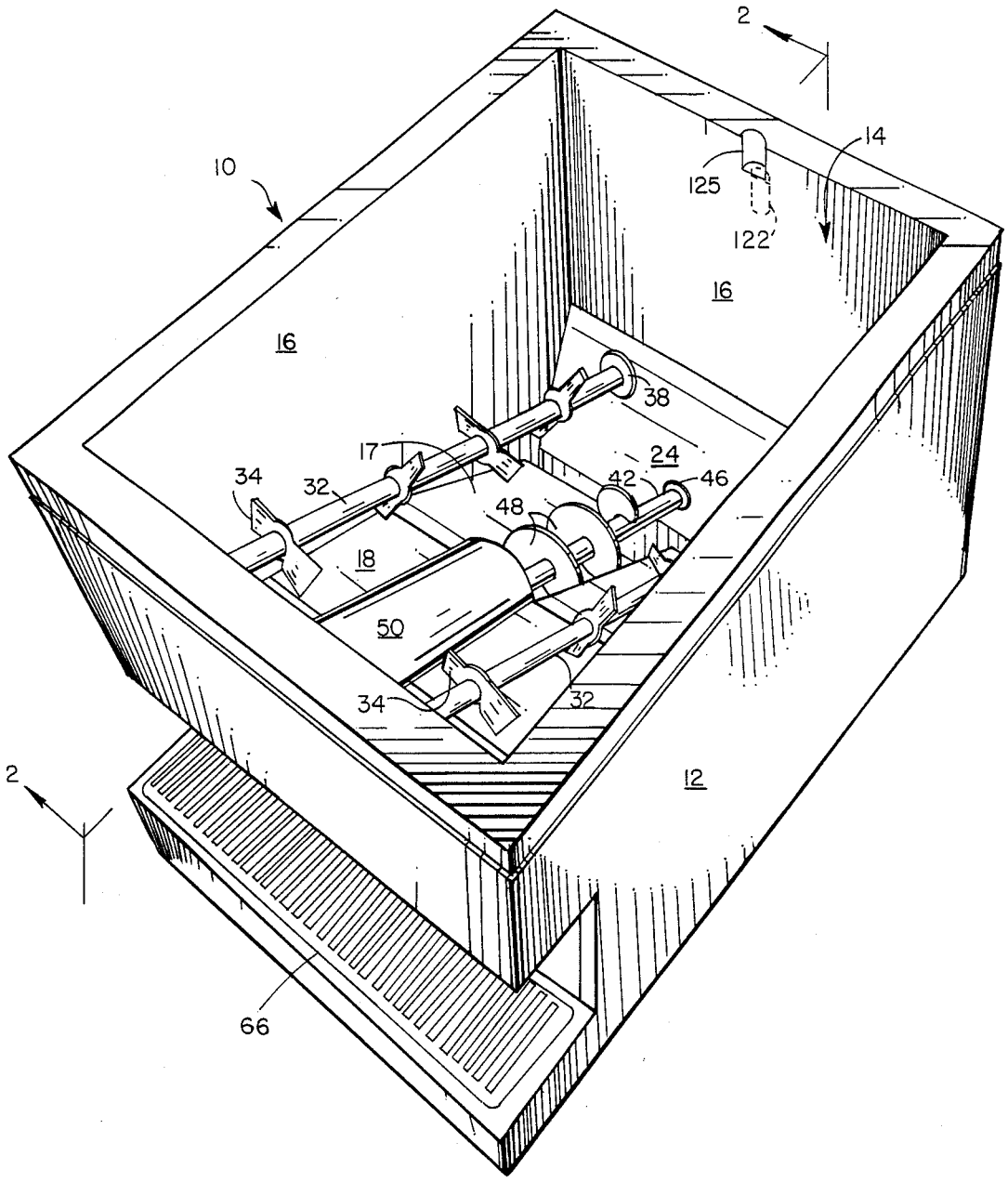
FIG. 1 is a perspective view of a presently preferred embodiment of an apparatus constructed according to the teachings of the present invention.
Figure 2:
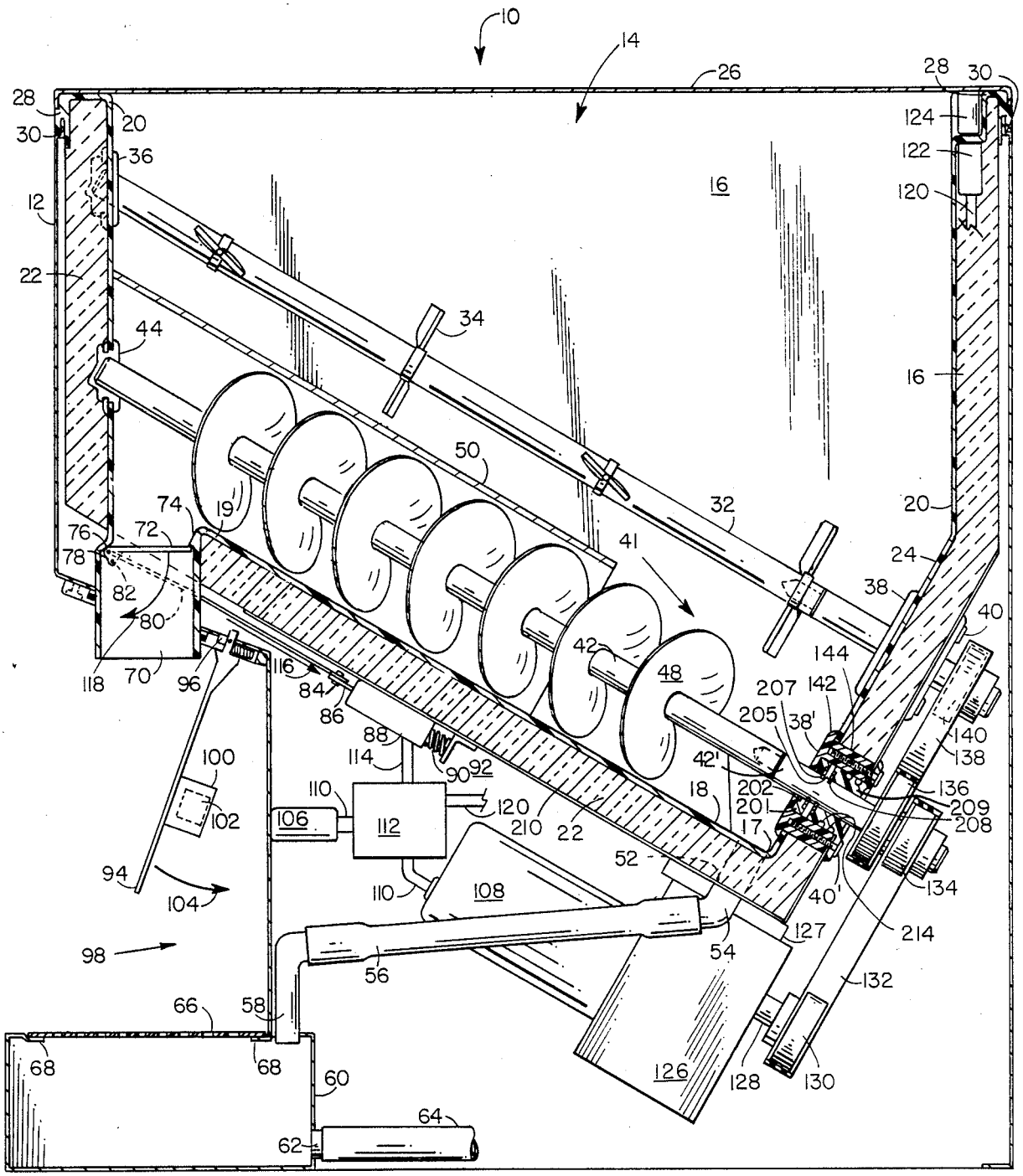
FIG. 2 is a sectional view taken along the lines 1—1 of the apparatus shown in FIG. 1.

Referring to FIG. 1, there is shown an apparatus for storing and dispensing particulate ice, designated generally at reference numeral 10, which is comprised of a case 12 having an ice hopper 14 contained therein. As best shown in FIG. 2, ice hopper 14 is provided with substantially vertical side walls 16 and a sloped floor 18 at the bottom thereof having a lower end 17 and an upper end 19. The side walls 16 and floor 18 of ice hopper 14 are comprised of a shell member 20 and an insulating material 22 integral therewith. Shell 20 can be constructed of plastic or metal, such as stainless steel, and insulating material 22 can be any material suitable for insulating ice hopper 14, and preferably water resistant.

A portion of the side wall 16, designated generally at reference numeral 24, of ice hopper 14 is slanted at the back end thereof to receive stirring bars 32—32' and shaft 42—42' as will be described. The outside surface of insulating material 22 in the area of the slanted portion 24, as well as the sloped floor 18, is provided with an outer shell 210. Ice hopper 14 is closed by lid 26 which rests on the shell 20. Shell 20 is provided with an overhanging lip 28 having slot 30 therein for receiving the walls of case 12.

Ice hopper 14 is also provided with a pair of stirring bars 32 having blades 34 mounted thereon for mechanically agitating the ice contained in ice hopper 14. Each of the stirring bars 32 is journaled at one end in a thrust bearing 36 which is mounted in the side wall 16 of ice hopper 14 (FIG. 2). The other end of each stirring bar 32 passes through a packing box or case 38 set in the back slanted portion 24 of side wall 16. To facilitate their removal from ice hopper 14, stirring bars 32 are comprised of two sections 32 and 32' held together by receipt of cone 33 integral with bar 32' within a complimentary cavity (not numbered). Packing boxes 38 prevent the passage of grease or other contaminants into the interior of ice hopper 14, and each is held in position against the back slanted portion 24 of side wall 16 by fastening means 40.

Figure 3:
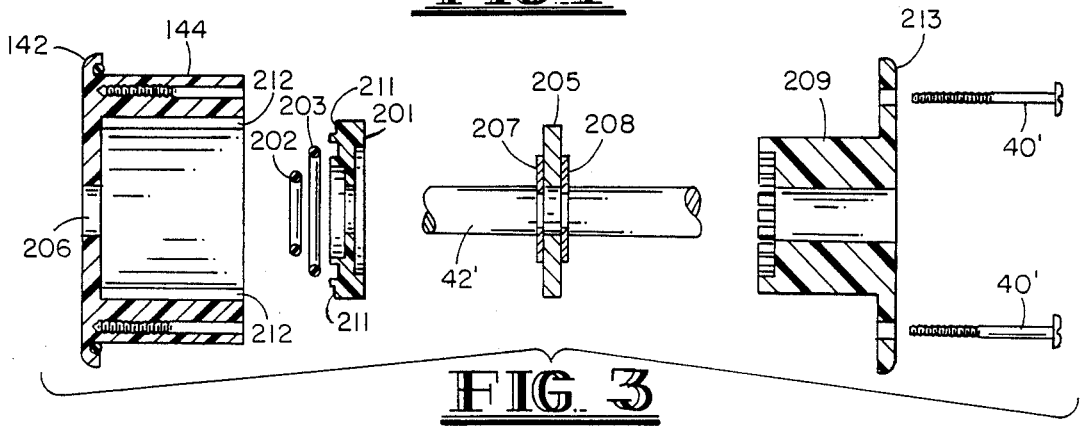
FIG. 3 is an enlarged, cross-sectional view of the packing case shown in FIG. 2.

Ice hopper 14 is also provided with means for moving particulate ice contained within ice hopper 14 upwardly along the sloped floor 18 from the lower end 17 to the upper end 19 thereof in the form of an auger assembly 41 having a two piece shaft 42—42' which is mounted at one end in a thrust bearing 44 similar to thrust bearings 36 and at the other end passes through a packing box 38' of the same type as packing boxes 38. Like stirring bars 32—32', the shaft 42 of auger assembly 41 is comprised of portions 42 and 42', held together by cone 46 in a cavity (not numbered) as described above for stirring bars 32—32'. Packing boxes 38 and 38' (also referred to as "packing cases" 38 and 38') are comprised of flange 142 and neck 144 portions, and enclose a bearing assembly which is comprised of seal cap 201, thrust washer 205 and thrust bearing 209 (see FIG. 3). Seal cap 201 is provided with shaft seal O-ring 202 sealing against shaft 42' and O-ring face seal 203 sealing against the inside face of the flange 142 of packing boxes 38 and 38' Seal cap 201 is prevented from rotating about shaft 42' by means of locking tabs 211 received within slot 212 located inside the neck 144 of packing boxes 38 and 38'. The flange 142 of packing boxes 38 and 38' is sealed against the surface of shell 20 by O-ring 204, and receives shaft 42' through opening 206 therein, shaft 42' also passing through seal cap 201 and shaft seal O-ring 202. Thrust washer 205 is mounted on shaft 42' through opening 206 therein, shaft 42' also passing through seal cap 201 and shaft seal O-ring 202. Thrust washer 205 is mounted on shaft 42' behind seal cap 201 and is held in place by retaining rings 207 and 208. Thrust bearing 209 is also mounted around shaft 42', and the flange 213 thereof bears against the outside surface of the outer shell 210 of ice hopper 14, being positively secured thereto by fastening means 40 which extend through the flange 213 into the neck 144 of packing box 38. Thrust bearing 209 also bears against thrust washer 205, thrust bearing 209 being positively engaged therewith by fastening means 40. Thrust bearing 209 is provided with one or more O-rings 214 for sealing against the neck 144 of packing case 38 (or 38').

Shaft 42—42' is provided with a plurality of flights 48 spaced therealong. Ice hopper 14 is provided with means for directing the ice contained therein to the lower end 17 of sloped floor 18 in the form of auger cover 50. Auger cover 50 covers the upper portion of auger assembly 41 and is integral with the side walls 16 of ice hopper 14.

The lower end 17 of floor 18 is provided with a drain 52. Drain 52 is set in the lower end 17 of floor 18 at an angle from the horizontal, thereby helping to prevent the freezing and/or ice hopper 14 is moved upwardly along the sloped floor 18 by the rotation of shaft 42—42', water drains back down floor 18 into drain 52 and out of ice hopper 14, through elbow 54, into hose 56 and elbow 58, and into drain pan 60. Drain pan 60 is provided with an outlet 62 having a hose 64 connected thereto for draining water received from elbow 58 as well as through the grating 66 which rests on the shoulder 68 of case 12.

The upper end 19 of floor 18 is provided with means for dispensing particulate ice from inside ice hopper 14 in the form of an ice chute 70 formed integrally in the floor 18. Ice chute 70 is provided with a trap door 72 which is biased by spring 90 as will be explained toward a first closed position in which trap door 72 abuts the shoulder 74 formed in the walls of ice chute 70. Biasing trap door 72 closed in this manner helps keep insects and other undesirables out of the interior of ice hopper 14. Trap door 72 is pivotally mounted on pin 76 to the walls of ice chute 70, as is lever arm 78, which is integral with trap door 72. Rod 80 is pivotally attached to lever arm 78 by rivet 82 at one end and by rivet 84 to the ear 86 of solenoid 88 at the other end. Spring 90 is bottomed against tab 92.

Referring once again to FIG. 2, the space 92 inside the substantially rectangular walls of case 12 and under the upper end 19 of floor 18 of ice hopper 14 is provided with means mounted to case 12 for selectively activating the ice moving means, thereby moving ice upwardly along the sloped floor 18 of ice hopper 14 to the ice chute 70 at the upper end 19 of floor 18 and out of ice hopper 14. The means for activating the ice moving means comprises a lever arm 94 pivotally mounted on pin 96 to case 12 in the recessed portion of the side walls of case 12 behind ice chute 70. Spring 97 biases lever arm 94 toward a first position in which trap door 72 is closed and motor 108 (see below) is not activated. Lever arm 94 is provided with a block 100 having a magnet 102, shown in shadow lines in FIG. 2, contained therein. When lever arm 94 is pushed from the first position in the direction of arrow 104 to a second position, the magnetic field of magnet 102 is detected by halogen switch 106, which closes a circuit to activate motor 108. Halogen switch 106 and motor 108 are connected, and the circuit formed, by wires 110 through junction box 112. At the same time that the circuit connecting the halogen switch 106 and motor 108 is completed to activate motor 108, the circuit including wires 114 through junction box 112 is completed to activate solenoid 88, thereby causing the rod 80 to move in the direction of arrow 116, compressing spring 90, to pivot trap door 72 in the direction of arrow 118 to a second, open position. The electric circuit also includes wires 120 which are connected to Hall effect sensor 122, which is a magnetic switch which is closed by the presence of the magnetic field of magnet 124 which is integral with the means for closing ice hopper 14, i.e, lid 26. Only when the lid 26 of case 12 is closed is the circuit completed by Hall effect sensor 122, thereby preventing the operation of stirring bars 32 and shaft 42—42' when the lid 26 is opened as a safety precaution. Motor 108 is provided with a gear box 126 through which drive shaft 128 carrying idler 130 thereon is driven. Idler 130 drives belt 132 to operate shaft 42—42' through pulley 134. Shaft 42—42' is also provided with an idler 136 which drives belt 138 to turn both stirring bars 32 through pulleys 140.

Having described the structure of a presently preferred embodiment of the invention, the method of using the invention will now be described with reference to the figures. The ice hopper 14 is first loaded with particulate ice. The ice contained within ice hopper 14 is then selectively mechanically agitated by stirring bars 32 having blades 34 thereon by pushing lever arm 94 in the direction of arrow 104 to complete the electric circuit through halogen switch 106, thereby activating motor 108 to turn stirring bars 32. The ice within ice hopper 14 is directed to the lower end 17 of the sloped floor 18 of ice hopper 14 by auger cover 50 and the slope in the floor 18 and, as shaft 42—42' turns in response to the completion of the circuit by halogen switch 106, the ice is moved by flights 48 upwardly along the sloped floor 18 of ice hopper 14 to dispense the ice through ice chute 70 from the upper end 19 of sloped floor 18 while draining the melt water from the ice through drain 52 at the lower end 17 of sloped floor 18. To prevent any bridging or congealing of the ice above trap door 72, thereby preventing the opening thereof in the direction of arrow 118, the flights 48 of shaft 42—42' are spaced at an interval defining a volume of space that has cross-sectional area (which cross-sectional area is that of the largest cross-section parallel to the shaft of auger assembly 41) smaller than the smallest area of the opening of ice chute 70. Spacing flights 48 in that manner insures that all of the ice which is moved into the area directly above ice chute 70 will fall out of ice hopper 14 through chute 70, thereby eliminating the possibility of blockage of the chute 70.

Although the invention has been described in terms of the above-characterized presently preferred embodiment, it will be understood by those skilled in the art who have the benefit of this disclosure that the embodiment described is but one device which may be constructed according to the teachings of the present invention and that other devices may be constructed without departing from the spirit of the present invention. It is contemplated that all such devices will be covered by the following claims.

I claim:

1. An apparatus for storing and dispensing particulate ice comprising:

an ice hopper for storage of particulate ice, said ice hopper further comprising a sloped floor;

a selectively actuable means for moving particulate ice contained within said ice hopper upwardly along said sloped floor from the lower end of said sloped floor to the upper end thereof, which ice-moving means has an axis of movement and is adapted to move particulate ice in a direction parallel to said axis of movement;

a first axial means for agitation ice contained within said hopper, which first agitating means is rotatably mounted within said hopper in an orientation having the axis of said first agitating means approximately parallel to said axis of movement of said ice moving means;

an opening in said ice hopper for dispensing particulate ice from said ice hopper, which opening is positioned to receive ice moved by said ice-moving means; and packing means mounted in a wall of said hopper, said first agitating means having a shaft along its axis which is rotatably mounted in said packing means, said packing means further comprising:

a packing case mounted in said wall and having a hole therethrough for receiving the shaft of said first agitating means;

a thrust bearing mounted in said wall and having a hole therethrough for receiving the shaft of said first agitating means; and a seal cap received within said hole in said packing case, said seal cap being provided with a means for sealing said seal cap against said shaft of said first agitating means and a means for sealing said seal cap against said packing case.

2. The apparatus of claim 1 wherein said packing case has a flange, and said seal cap is received between said flange and said thrust bearing.

3. The apparatus of claim 1 wherein said seal cap is secured against rotational movement relative to said packing case.

4. The apparatus of claim 1 wherein said shaft of said first agitating means has a thrust washer mounted thereon, said thrust washer being received within the hole in said packing case between said seal cap and said thrust bearing.

5. The apparatus of claim 4 wherein said shaft of said first agitating means is further provided with means for holding said thrust washer in place along said shaft.

6. The apparatus of claim 5 further comprising means for fastening said thrust bearing to said packing case.

7. The apparatus of claim 1 or claim 5, wherein said seal cap is provided with a tab thereon and said packing case is provided with a slot for receiving the tab of said seal cap to secure said seal cap against rotational movement relative to said packing case.

* * * * *